United States Patent [19]

Takayanagi

[11] Patent Number: 4,624,548

[45] Date of Patent: Nov. 25, 1986

[54] IMAGE DENSITY CONTROL DEVICE

[75] Inventor: Yoshiaki Takayanagi, Ichikawa, Japan

[73] Assignee: Canon Kabushiki Kaisha, Tokyo, Japan

[21] Appl. No.: 632,006

[22] Filed: Jul. 18, 1984

[30] Foreign Application Priority Data

Jul. 22, 1983 [JP] Japan ..... 58-134838
Jul. 22, 1983 [JP] Japan ..... 58-134839

[51] Int. Cl.[4] ..... G03G 15/00

[52] U.S. Cl. ..... 355/14 D; 355/3 DD; 355/14 CH; 355/14 E

[58] Field of Search ..... 355/14 E, 14 R, 3 R, 355/8, 67–69; 118/691, 712, 624

[56] References Cited

U.S. PATENT DOCUMENTS

| | | | |
|---|---|---|---|
| 3,749,488 | 7/1973 | DeLorme | 355/3 R |
| 3,926,518 | 12/1975 | Berry et al. | 355/68 X |
| 4,095,887 | 6/1978 | Van Herten et al. | 355/3 BE |
| 4,153,364 | 5/1979 | Suzuki et al. | 355/14 E |
| 4,157,822 | 6/1979 | Miller | 355/14 SH X |
| 4,170,414 | 10/1979 | Hubert et al. | 355/14 SH |
| 4,200,391 | 4/1980 | Sakamoto et al. | 355/14 E |
| 4,239,374 | 12/1980 | Tatsumi et al. | 355/14 D X |
| 4,352,553 | 10/1982 | Hirahara | 355/14 E |
| 4,354,758 | 10/1982 | Futaki | 355/68 X |
| 4,355,885 | 10/1982 | Nagashima | 355/14 CH |
| 4,564,287 | 1/1986 | Suzuki et al. | 355/14 CH X |

*Primary Examiner*—A. C. Prescott

*Attorney, Agent, or Firm*—Fitzpatrick, Cella, Harper & Scinto

[57] ABSTRACT

There is disclosed an image density control device having original density detector, a leading edge detector for detecting a leading edge of original, and controller for controlling image forming conditions in accordance with an output of said original density detector. An optimum control of the image forming conditions is performed by means of combination of the original density detected by said original density detector in a predetermined area divided in original area or for a given period of time from an output signal generated from said leading edge detector, and the original density detected by said density detection means in an area located before or after said predetermined area or for a period of time before or after said given period of time.

7 Claims, 18 Drawing Figures

IMAGE DENSITY CONTROL DEVICE

BACKGROUND OF THE INVENTION

1. Field of the Invention

The present invention relates to a device for properly controlling image density in an image forming equipment such as a typical copying machine.

2. Description of the Prior Art

For adjusting the density of a transfer image of a copying machine, means for changing the lighting voltage of an original exposure lamp LA1 as shown in FIG. 2 by adjusting a volume VR1 in the operation unit as shown in FIG. 1 has been employed generally. Such prior art method, however, has a drawback in that the quantity of copy sheets to be used increases more than the quantity of sheets required, since in many cases several copy sheets are wasted until an optimum image is obtained.

Alternatively, there is a method wherein original density is detected and image forming conditions, such as the quantity of charge, the quantity of exposure, and the development bias voltage, are controlled according to the detected density. Such method, however, has a drawback in that the copying time is lengthened since scanning for detecting the original density is required before the original scanning for copying.

SUMMARY OF THE INVENTION

It is an object of the present invention to provide an improved image density control device for controlling the image density optimumly.

It is a further object of the present invention to provide an image density control device capable of controlling the image density optimumly without lengthening the time required for image forming.

It is a further object of the present invention to provide an image density control device capable of preventing wasteful use of recording material.

It is a further object of the present invention to provide an image density control device capable of providing images of good reproducibility for thin character original images and images free of fog for thick originals typically of newspapers.

The above and other objects of the present invention will be described in detail.

BRIEF DESCRIPTION OF THE DRAWINGS

FIGS. 5-1 through 7 are flowcharts of the present invention;

FIGS. 12-1 and 12-2 show the relationship between bias control voltages and original density sampling areas.

DETAILED DESCRIPTION OF THE PREFERRED EMBODIMENTS

The present invention will now be described in detail based on the preferred embodiments.

Figure 3:
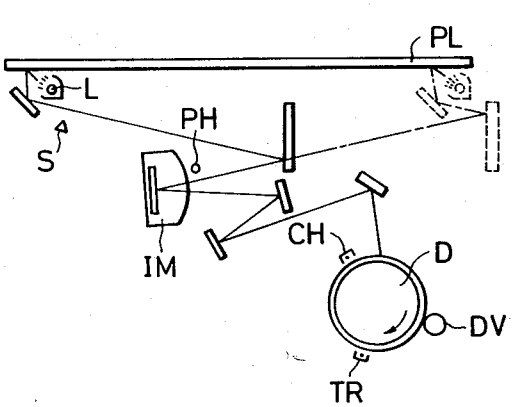
FIG. 3 is a schematic drawing showing the composition of a copying equipment.

FIG. 3 shows an embodiment of the copying equipment to which the present invention is applied. A photosensor, a photodiode in the present invention, is provided in front of an in-mirror lens IM, and the intensity of light reflected from an original glass is detected. D is a photosensitive drum, L is an original exposure lamp, CH is a charger for charging the photosensitive drum D uniformly, DV is a developer roller of a developer for developing static latent images formed on the photosensitive drum D to which (DV) a given bias voltage is applied, and TR is a transfer charger for transferring a developed image formed on the photosensitive drum D to a copy sheet.

Figure 4:
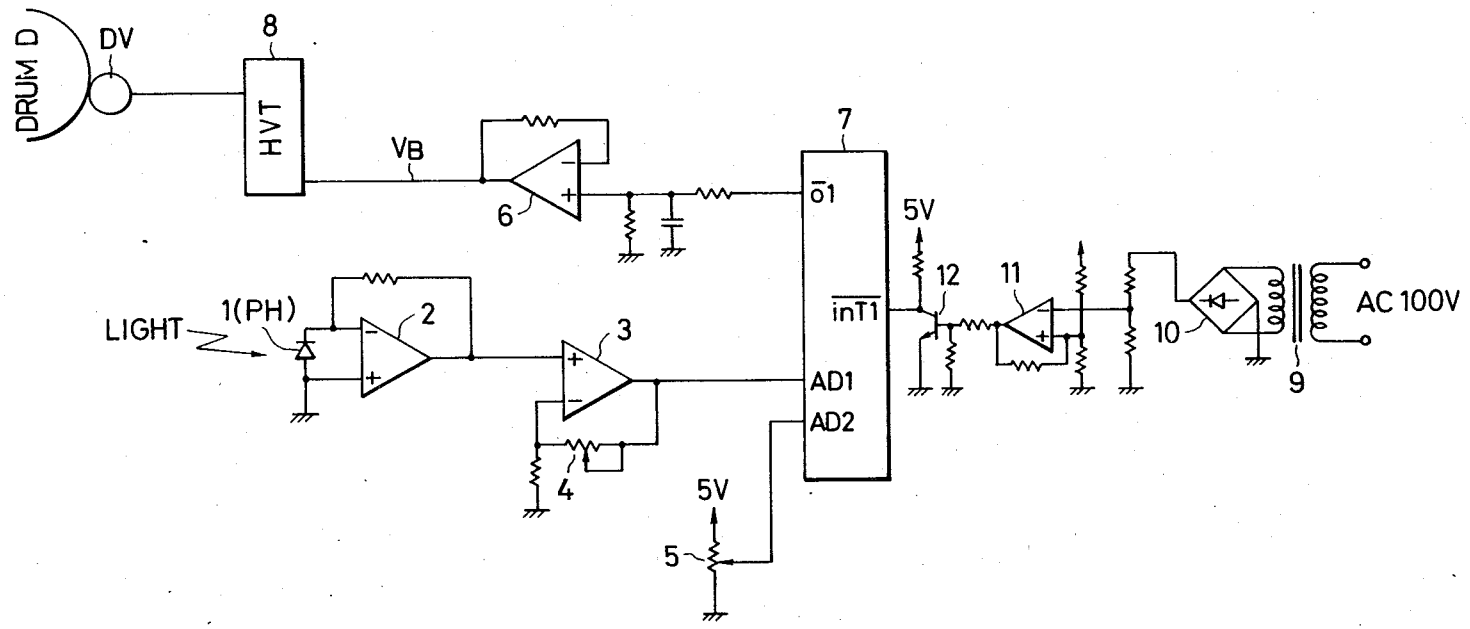
FIG. 4 is a typical circuit diagram for realizing the present invention.

FIG. 4 shows an original density detecting circuit. A detected signal from a PH photodiode 1 is amplified at an operational amplifier 2, subjected to gain control at an operational amplifier 3, and fed to the AD1 input of a microcomputer 7 with a built-in AD converter. The microcomputer 7 outputs a pulse width modulated pulse from an output port $\overline{O1}$ according to the input level of AD1 and the input level of AD2 which is determined by a later-mentioned volume 5, outputs making the output level of an OP-amp 6 proportional to the pulse width by inputting the pulse to the OP-amp 6 through integration, and controls development bias DC components at a high tension transformer 8. 9 is a transformer, the secondary side is full-wave rectified, and AC zero crossing detection is performed by an OP-amp 11. The zero crossing pulse is fed to an interruption terminal $\overline{INT1}$ of the microcomputer 7, the input at ADI is read by the program of FIG. 5-1 or FIG. 5-2 through the ensuing interruption processing, and the development bias is controlled.

Figure 1:
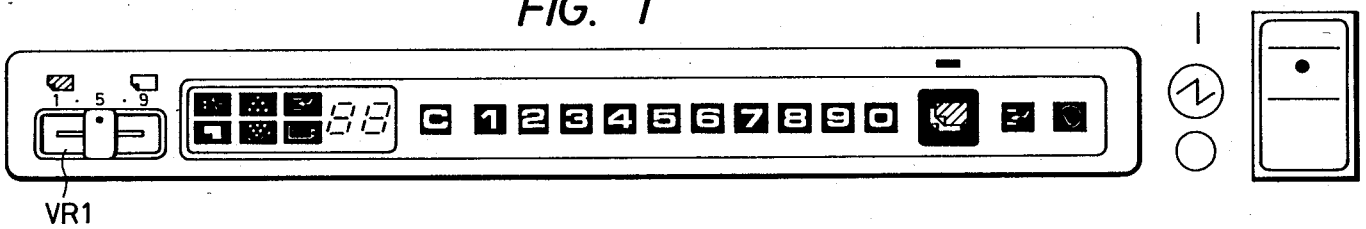
FIG. 1 is a view showing the operation unit of a copying machine.
Figure 2:
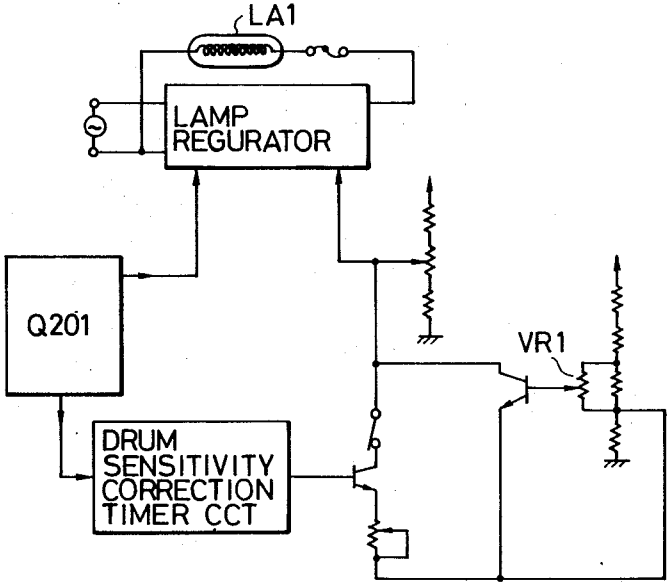
FIG. 2 is a prior art density control circuit diagram.
Figures 1, 1A, 5:
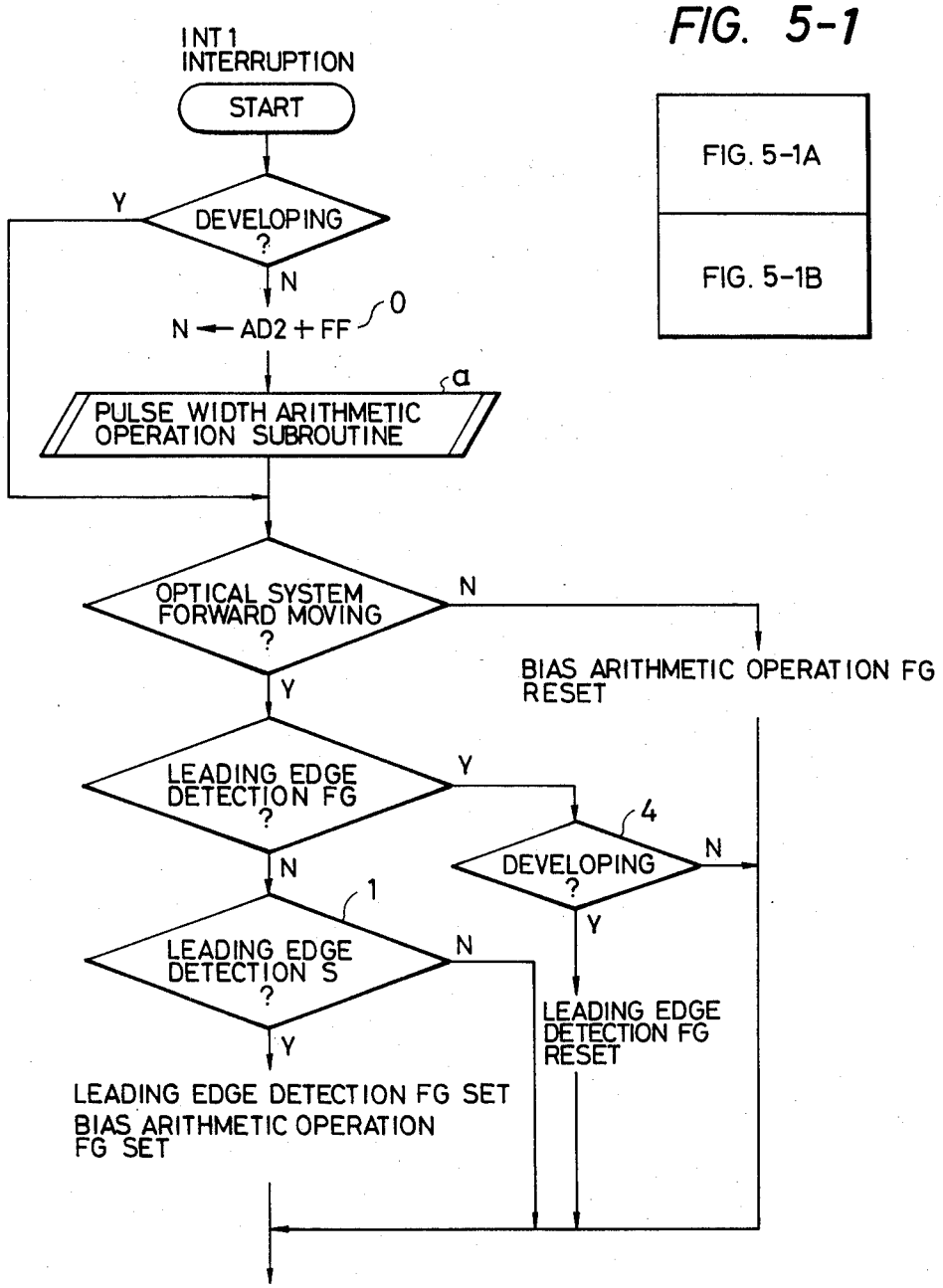
Figures 1B, 5:
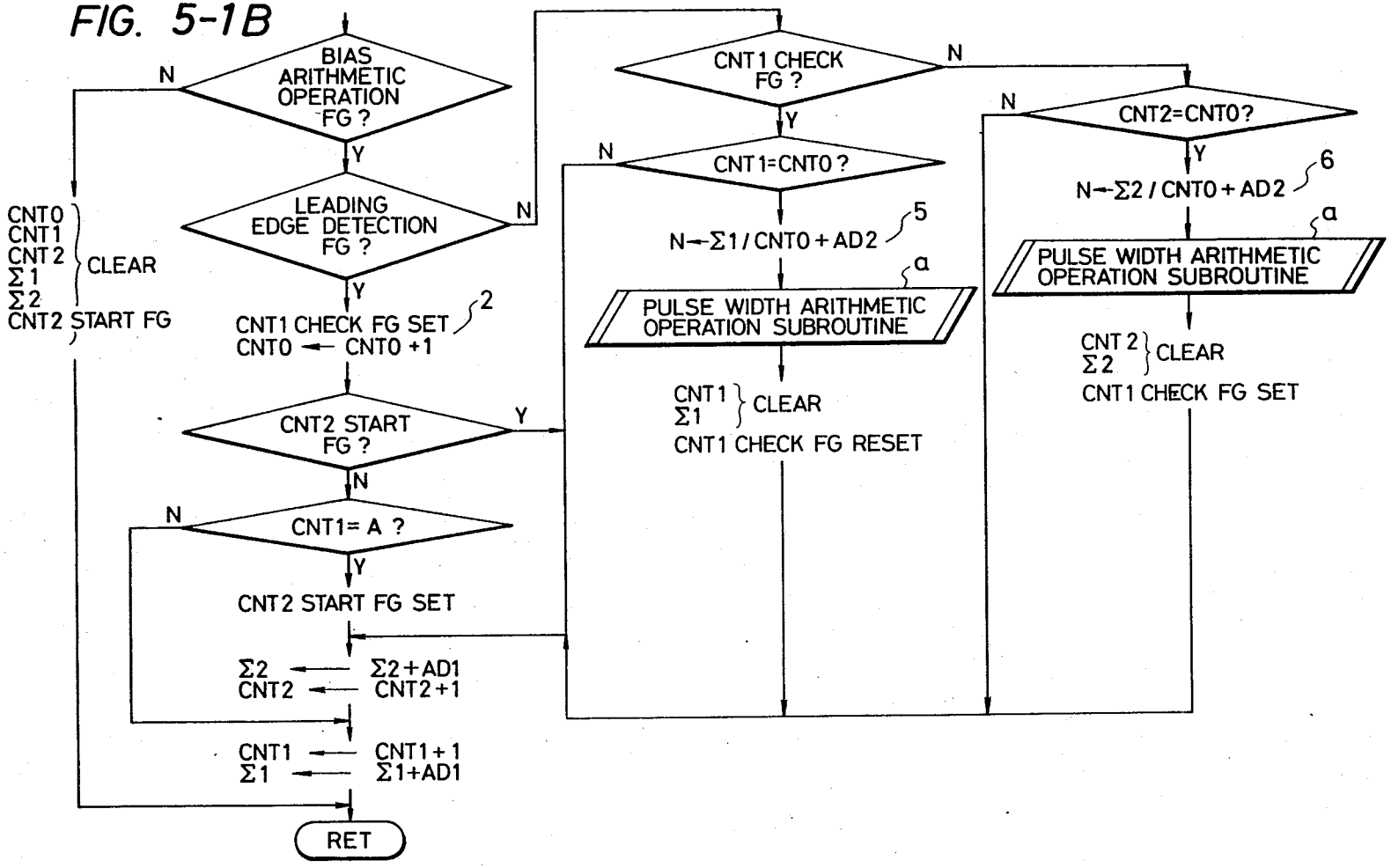
Figures 2, 2A, 5:
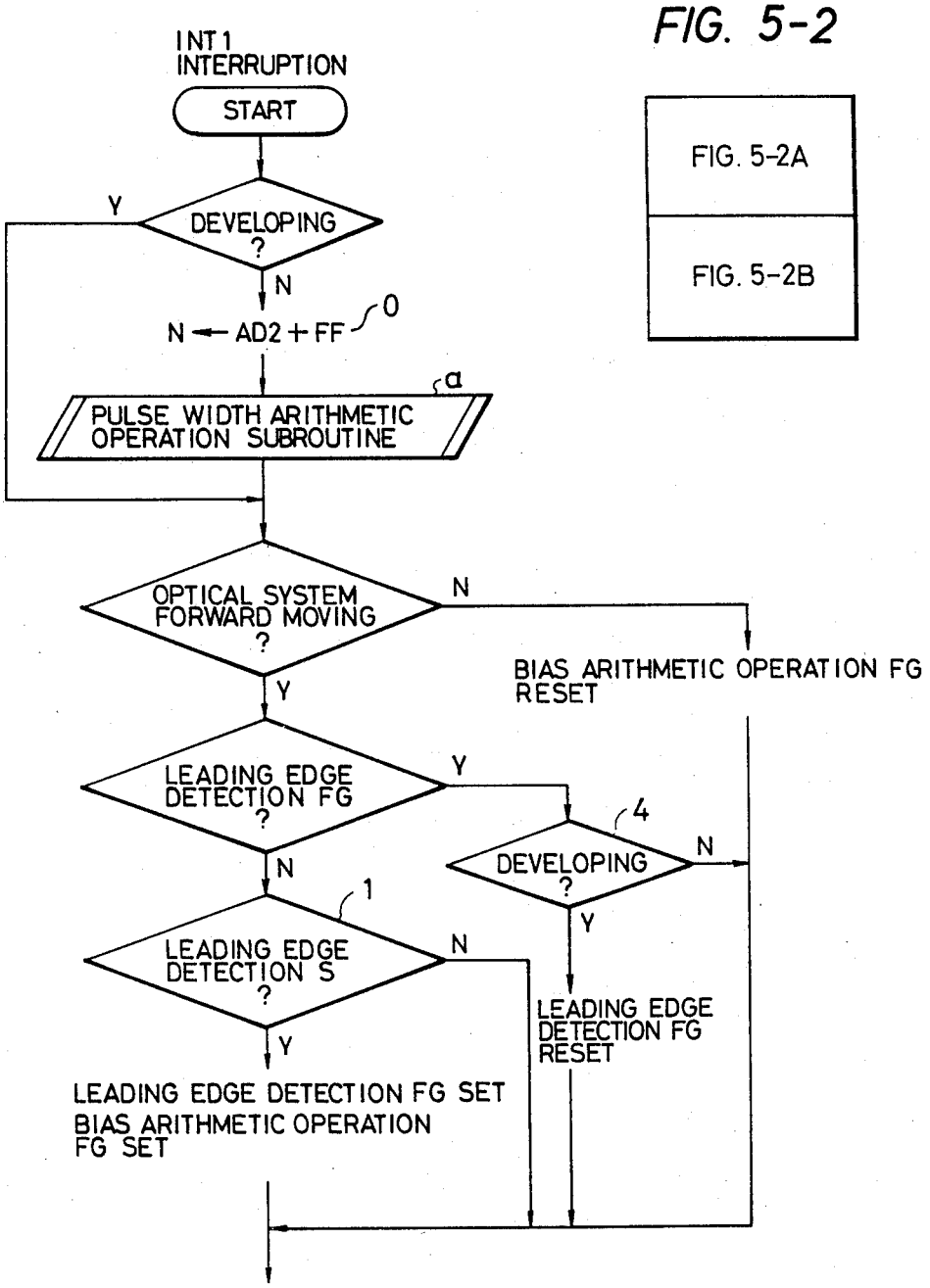
Figures 2B, 5:
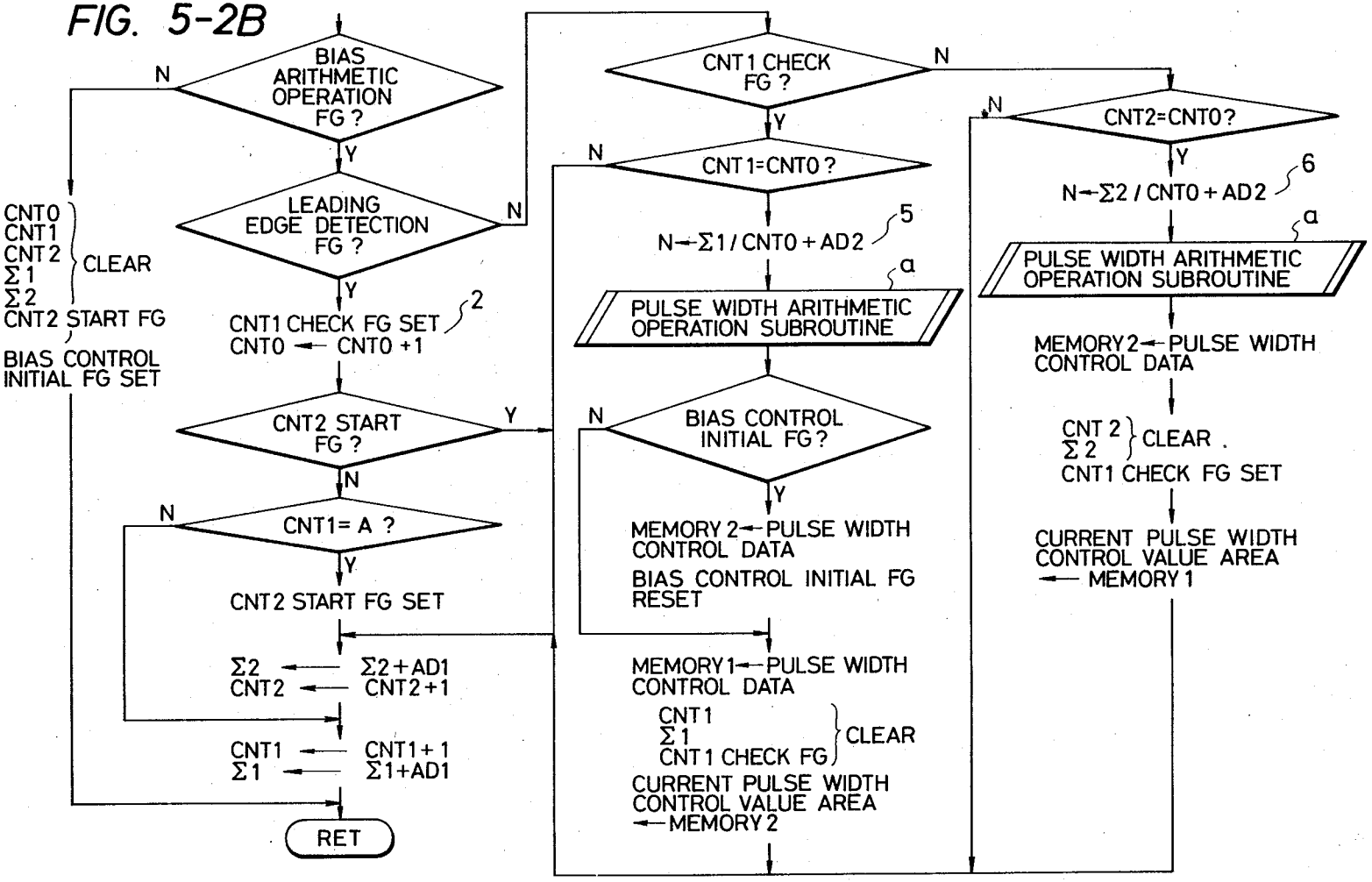

FIG. 5-1 is a flowchart when the arithmetic operation of bias voltage is performed by the sampling data which contains not only a control area (n) but a control area (n+1) which immediately follows. FIG. 5-2 is a flowchart when arithmetic operation of control voltage is performed by the sampling data containing not only the control area (n) but a control area (n−1) which immediately precedes.

Figure 6:
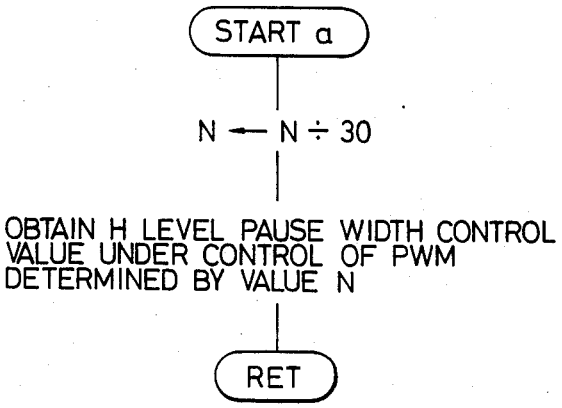
Figure 8:
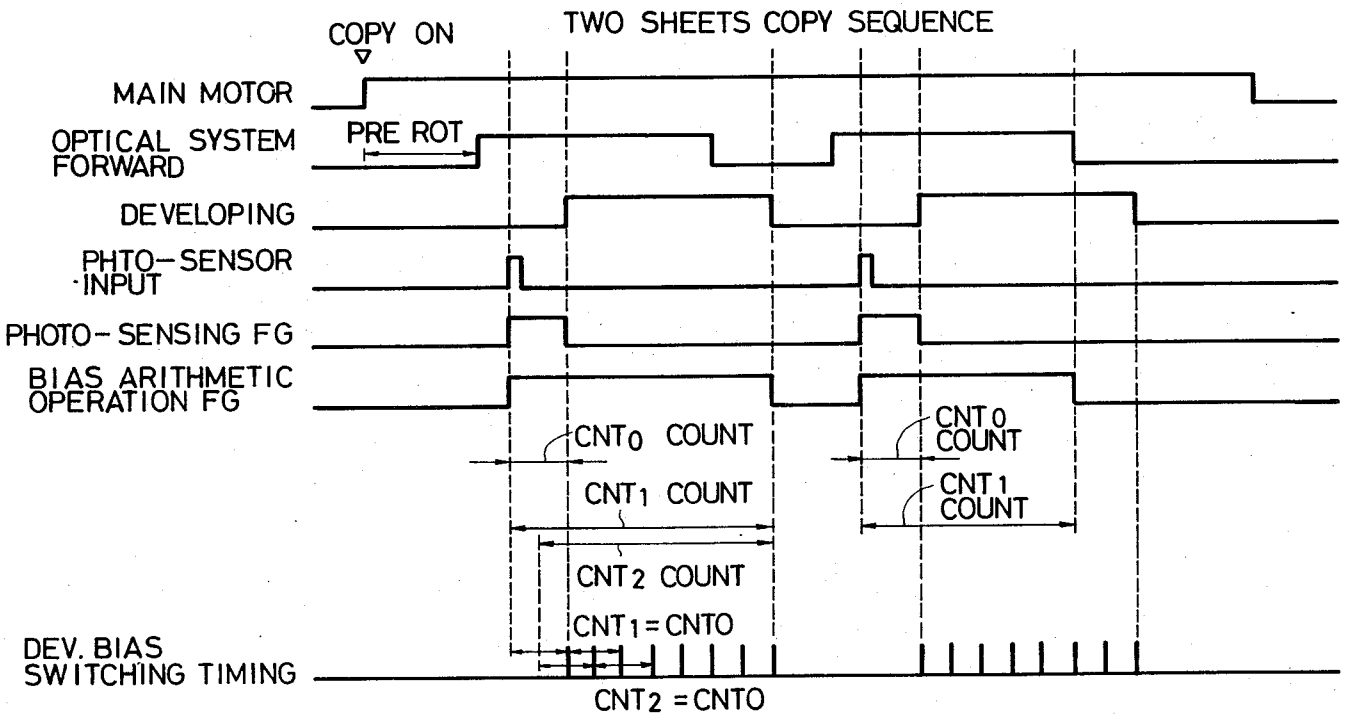
FIG. 8 is a sequence timing chart.

FIG. 5-1 will now be described. The relationship between each flag (FG) and the sequence is shown in FIG. 8. As a copy button is pressed, a main motor starts running. When pre-running for the removal of residual charge of the drum and cleaning completed, an optical system starts moving forward. When there is an input of a sensor S notifying its detection of the leading edge of the original while the optical system is moving forward (step 1), a time counter CNT0 starts incrementing the time until the leading edge arrives at the development operation (step 2), and the time spent from the exposure of the original leading edge to the development of the latent image is measured based on the count up value of the counter CNT0. Before the development start-up, a bias obtained by adding AD2 to a preset value FF is applied so that the toner does not stick to the drum surface (step 0). During that time, the input from AD1 is sampled and added to the value of Σ1 (step 3). When an FG indicating the developing state after a lapse of the above time is set (step 4), the value of Σ1 is divided by CNT0, a mean value of AD1 is calculated, input AD2 from a fine adjustment volume 5 (FIG. 3) is added thereto, and an H level pulse width control value T (step 5) at PWM which is determined by the value N (step 5) of the above sum is obtained as shown in FIG. 6 routine a. Counters CNT0, CNT1 and CNT2 increment at each INT input pulse.

Figure 7:
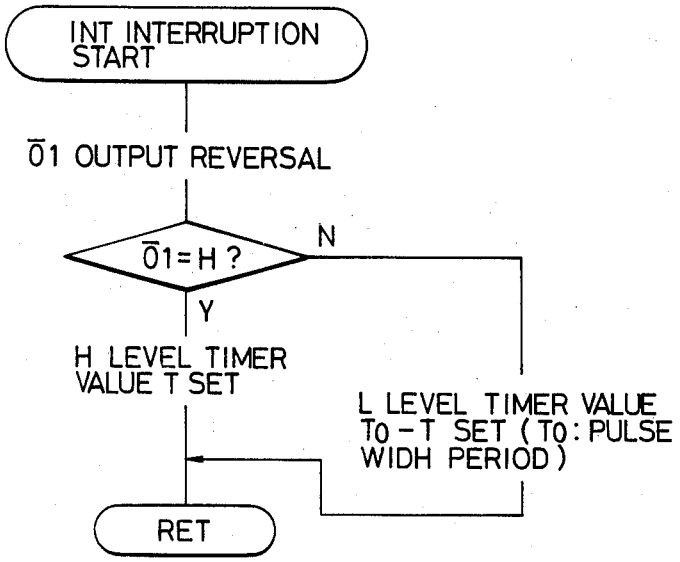
Figure 9:
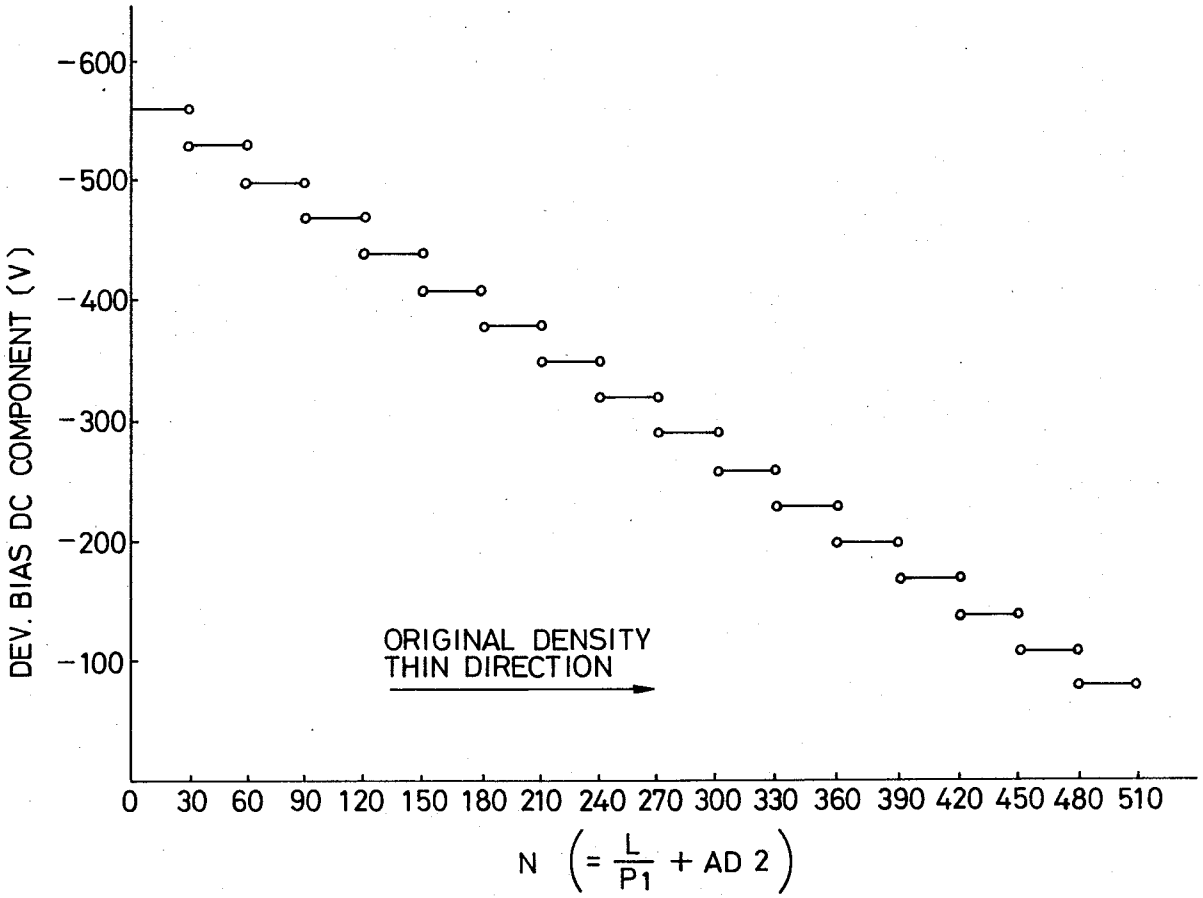
FIG. 9 shows the relationship between calculated values and development bias DC components.
Figure 10:
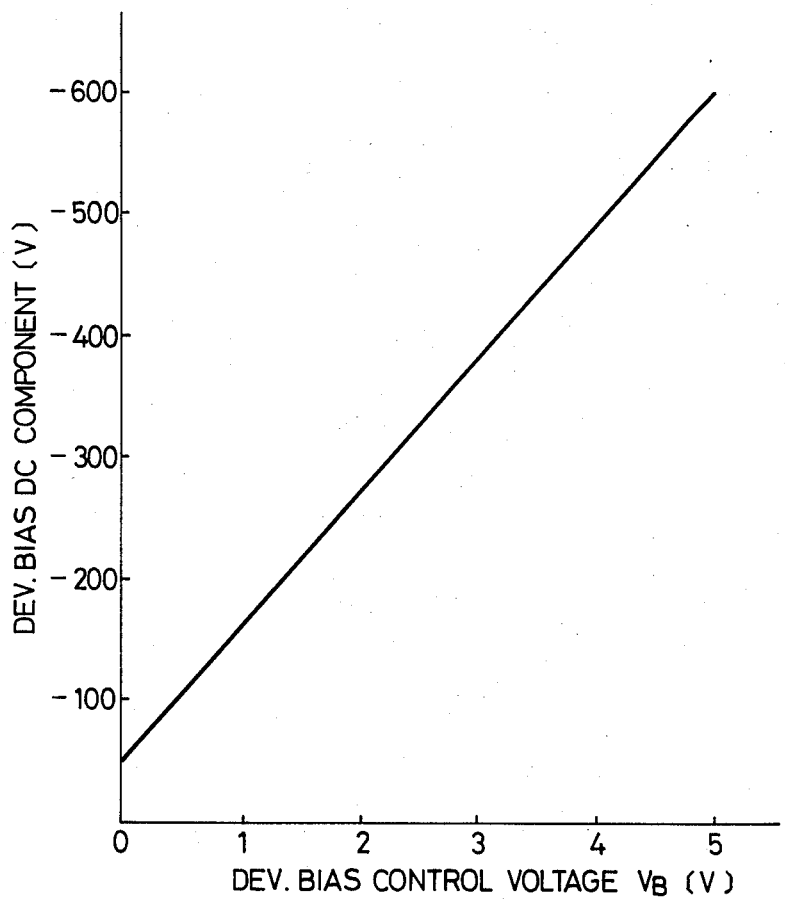
FIG. 10 shows the relationship between development bias control voltages and development bias DC component.

The reason why the value N is divided by 30 in FIG. 6 is that the aforementioned $$N\left(\leftarrow \frac{L}{P1}\frac{(\Sigma 1 \text{ or } \Sigma 2)}{(CNT0)} + AD2\right)$$

is 0 at the minimum and 510 at the maximum since the A/D converter is 256 LSB and these can be divided to 18 when divided by the 30 LSB unit. Accordingly, by controlling the pulse width to be output to the port $\overline{O1}$ (FIG. 4) for each value of N←N÷30, the development bias DC component can be varied as shown in FIG. 9. The development bias DC component varies over the range from −50 to −600 V according to the development bias control voltage $V_B$ shown in FIG. 4, and for controlling this $V_B$ the pulse width to be output from the output port $\overline{O1}$ of the microcomputer is controlled. FIGS. 6 and 7 show the control flowcharts. FIG. 7 shows the timer internal interruption program which starts at power ON, and then starts on the interruption when its time is up.

Figures 1, 12:
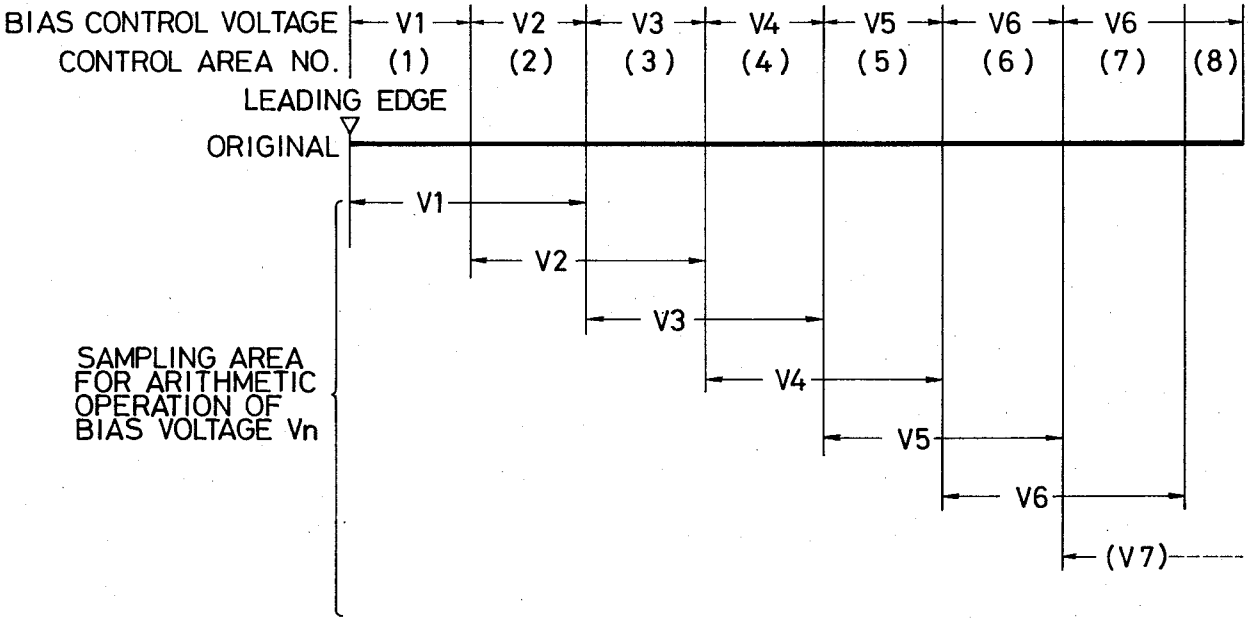
Figures 2, 12:
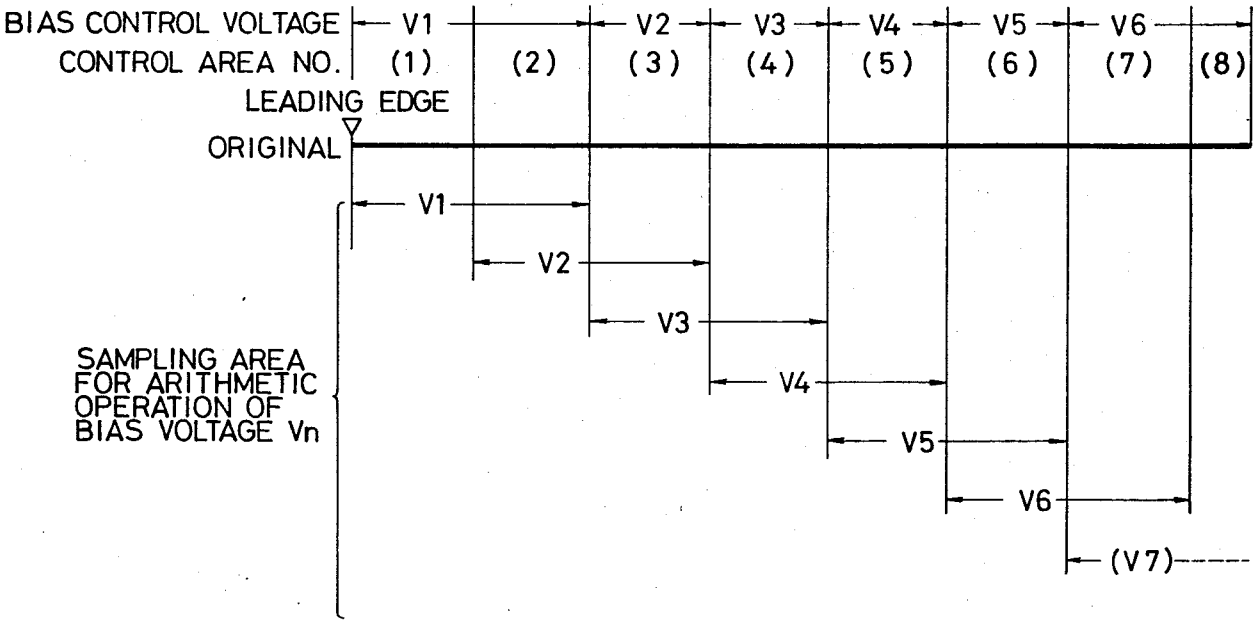

On the other hand, the counter CNT2 starts at a point (CNT1=A) during the time from a leading edge signal input by the sensor S to the development start-up. As shown in FIGS. 8 and 12-1, the counters CNT1 and CNT2 serve to discriminate the sampling area for obtaining bias voltage through arithmetic operation, and the bias voltage Vn is calculated from the mean value of input data from the photosensor 1 of FIG. 4 which sampled the control area (n) shown in FIG. 12-1 and the area (n+1) which immediately follows during the original exposure and controlled by this value. For CNT1, a bias output is determined by averaging Σ1 (step 5). For CNT2, a bias output is determined by averaging Σ2 (step 6).

FIG. 5-2 shows a flowchart when a bias control voltage Vn is obtained by the arithmetic operation based on the average value of data obtained by the sampling of the control area (n) and the area (n−1) which immediately precedes while the original is being exposed. FIG. 12-2 shows the relationship between the bias control voltage and the sampling area in this case.

Since the bias control voltage Vn is obtained by the arithmetic operation based on the data of sampling including not only the control area (n) but the area (n−1) which immediately precedes or the area (n+1) which immediately follows, a suitable continuity can be provided to the development bias value for controlling against the original density variation between the control areas.

In addition, since image forming conditions are controlled while the copying operation is performed, prescan for detecting the original density in advance becomes unnecessary, with the resultant shortening of copying time.

Now, since the photosensitive drum is an OPC drum and the primary charge is negative charge, when the development bias DC component is increased on the negative side, the quantity of development becomes in the reducing direction, and the copied image becomes thin. Accordingly, it is designed so that as the value N becomes larger as shown in FIG. 9, that is, as the original density becomes thinner, the minus value of the development bias DC component is made smaller, the quantity of development is made larger, and thin character reproducibility is made better. On the other hand, for the original of high density, such as newspaper, the development bias DC component is made larger, and control in the direction eliminating fogs in the copied image is performed.

Figure 11:
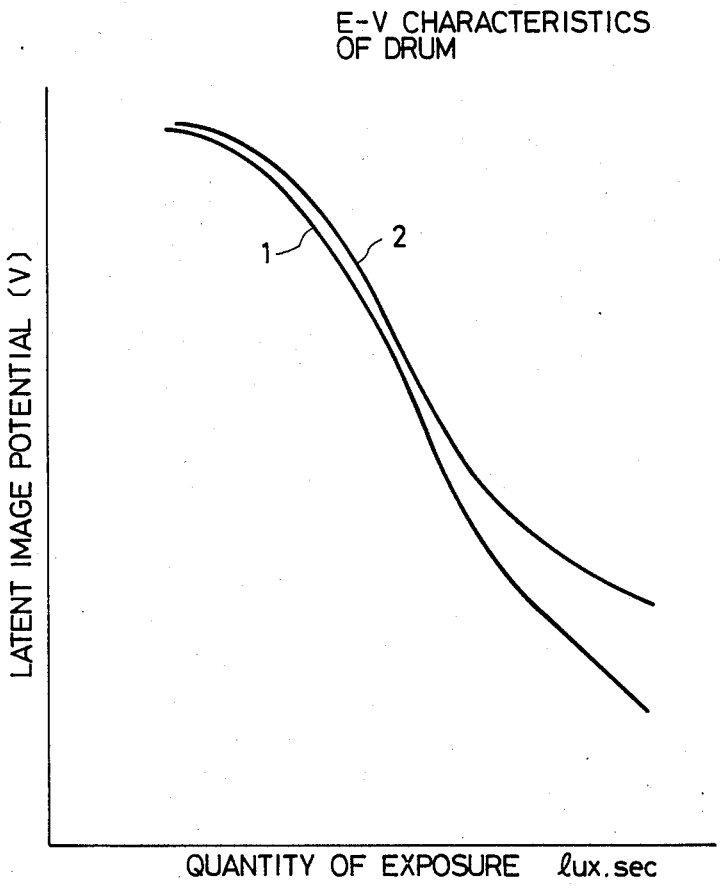
FIG. 11 is an E–V characteristics diagram of the drum.

The volume 5 shown in FIG. 4 is a means for correcting the development bias DC component suitably so as to obtain an optimum copied image when the E–V characteristics of the drum changed from the curve 1 to the curve 2 due to drum deterioration as shown in FIG. 11.

Although the present invention has been described in connection with the particular embodiments shown and discussed hereinabove, it is to be expressly understood that many other alternations and modifications may be made without departing from the spirit and scope of the present invention. For example, though the development bias is controlled by the arithmetic operation of sampling data dividing the original scan section by setting the time from the reception of an input signal from the original leading edge sensor to the development of the image leading edge as reference, the scan section may be divided taking other suitable predetermined scan time width as reference. Typically in the case of a copying machine having image size changing function, since the scan speed of the optical system varies according to the magnification, control is typically effected by dividing the scan section based on a predetermined scan distance is effective. Control can also be made by measuring the potential on the photosensitive drum immediately after exposure and performing the aforementioned arithmetic operation.

What I claim is:

1. An image density control device comprising:

density detection means for detecting the density of an original, while an image forming operation is performed on a recording material;

leading edge detection means for detecting a leading edge of the original; and control means for controlling image forming conditions of an image forming means according to an output of said density detection means, wherein said control means controls said image forming conditions optimumly by means of a combination of the original density detected by said density detection means, in a divided predetermined area or for a given period of time from a signal corresponding to the original leading edge to be output from said leading edge detection means, and the original density detected by said density detection means, in an area located before or after said predetermined area or for a period of time before or after said given period of time.

2. The image density control device according to claim 1, wherein said density detection means detects original density by detecting the intensity of light reflected from the original.

3. The image density control device according to claim 1, wherein said image forming means has reciprocating means for exposure scanning the original and said leading edge detection means is provided on the travel path of said reciprocating means.

4. The image density control device according to claim 1, wherein said image forming means has latent image forming means for forming a latent image on the recording element and developing means for developing said latent image, and said control means controls said developing means.

5. The image density control device according to claim 4, wherein said control means controls bias voltage of said developing means.

6. An image density control device comprising:

density detection means for detecting the density of an original, while an image forming operation is performed on a recording material;

leading edge detection means for detecting a leading edge of the original; and control means for controlling image forming conditions of an image forming means according to an output of said density detection means, wherein said control means has a first sampling processing means for an output of said density detection means based on a signal corresponding to the original leading edge to be output from said leading edge detection means and a second sampling processing means for performing a plural number of sampling processings for said density detection means output, starting before completion of a sampling processing of said first sampling processing means, and controls said image forming conditions optimumly by performing sampling processings by said first and second sampling processing means parallelly and repeatedly.

7. The image density control device according to claim 6, wherein said control means has a digital computer capable of program interruption, and performs said sampling processing through program interruption by a series of pulses.

* * * * *

UNITED STATES PATENT AND TRADEMARK OFFICE

CERTIFICATE OF CORRECTION

PATENT NO. : 4,624,548

DATED : November 25,1986

INVENTOR(S) : YOSHIAKI TAKAYANAGI

It is certified that error appears in the above-identified patent and that said Letters Patent is hereby corrected as shown below:

AT [57] IN THE ABSTRACT

Line 9, "divided in" should read --divided from an--.

SHEET 1 OF 13

FIG.2, "LAMP REGURATOR" should read --LAMP REGULATOR--.

SHEET 7 OF 13

FIG.7, "WIDH PERIOD" should read --WIDTH PERIOD--.

COLUMN 1

Lines 34 & 37, "optimumly" should read --optimally--.

COLUMN 2

Line 39, "ADI" should read --AD1--.

COLUMN 4

Line 21, "alternations" should read --alterations--.

UNITED STATES PATENT AND TRADEMARK OFFICE

CERTIFICATE OF CORRECTION

PATENT NO. : 4,624,548

DATED : November 25, 1986

INVENTOR(S) : YOSHIAKI TAKAYANAGI

It is certified that error appears in the above-identified patent and that said Letters Patent is hereby corrected as shown below:

COLUMN 4

Line 51, "optimumly" should read --optimally--.

COLUMN 6

Line 10, "optimumly" should read --optimally--.

Signed and Sealed this

Twenty-first Day of April, 1987

*Attest:*

DONALD J. QUIGG

*Attesting Officer*

*Commissioner of Patents and Trademarks*